US010941678B2

(12) United States Patent
Suzuki et al.

(10) Patent No.: US 10,941,678 B2
(45) Date of Patent: Mar. 9, 2021

(54) ADJUSTING DEVICE WITH SEALED GUIDE CYLINDER

(71) Applicant: Kendrion (Villingen) GmbH, Villingen-Schwenningen (DE)

(72) Inventors: Tsuneo Suzuki, Moenchweiler (DE); Wolfram Maiwald, Obereschach (DE); Harald Burkart, Villingen-Schwenningen (DE); Michael Tischtschenko, Trossingen (DE); Andreas Kammerer, Obereschach (DE)

(73) Assignee: Kendrion (Villingen) GmbH, Villingen-Schwenninge (DE)

( * ) Notice: Subject to any disclaimer, the term of this patent is extended or adjusted under 35 U.S.C. 154(b) by 0 days.

(21) Appl. No.: 16/649,488

(22) PCT Filed: Aug. 14, 2018

(86) PCT No.: PCT/EP2018/072039
§ 371 (c)(1),
(2) Date: Mar. 20, 2020

(87) PCT Pub. No.: WO2019/057401
PCT Pub. Date: Mar. 28, 2019

(65) Prior Publication Data

US 2020/0308994 A1 Oct. 1, 2020

(30) Foreign Application Priority Data

Sep. 21, 2017 (DE) ..... 10 2017 121 947.1

(51) Int. Cl.
*F01L 1/047* (2006.01)
*F01L 1/22* (2006.01)
(Continued)

(52) U.S. Cl.
CPC *F01L 1/22* (2013.01); *F01L 1/14* (2013.01); *F01L 1/46* (2013.01); *H01F 7/081* (2013.01);
(Continued)

(58) Field of Classification Search
CPC ..... F01L 2001/0473; F01L 1/46; F01L 2009/0423; F01L 2013/0052; F01L 2013/101; F01L 2820/031
(Continued)

(56) References Cited

U.S. PATENT DOCUMENTS 3,460,081 A 8/1969 Tillman
3,755,766 A 8/1973 Read
(Continued)

FOREIGN PATENT DOCUMENTS

DE 1442190 5/1996
DE 102006051809 5/2008
(Continued)

OTHER PUBLICATIONS

World Intellecutal Property Organization, "Search Report," and English language translation, issued in International Application No. PCT/EP2018/072039, dated Nov. 28, 2018, document of 7 pages.

*Primary Examiner* — Jorge L Leon, Jr.
(74) *Attorney, Agent, or Firm* — Akerman LLP; Peter A. Chiabotti

(57) ABSTRACT

An adjusting device having at least one tappet assembly. The at least one tappet assembly comprises a tappet, at least one guide cylinder, and a pole core. The tappet is arranged in the guide cylinder in a movable manner along a longitudinal axis, and a non-magnetic connection socket is arranged between the guide cylinder and the pole core. The guide cylinder and the pole core are arranged at a distance to each other in the longitudinal axis by the connection socket.

18 Claims, 2 Drawing Sheets

(51) Int. Cl.

| | |
|---|---|
| ***F01L 1/14*** | (2006.01) |
| ***F01L 1/46*** | (2006.01) |
| ***H01F 7/08*** | (2006.01) |
| ***H01F 7/16*** | (2006.01) |

(52) U.S. Cl.
CPC ..... *H01F 7/16* (2013.01); *F01L 2820/00* (2013.01); *H01F 2007/1692* (2013.01)

(58) Field of Classification Search
USPC ..... 123/90.18, 90.37, 90.38
See application file for complete search history.

(56) References Cited

U.S. PATENT DOCUMENTS

| | | | | |
|---|---|---|---|---|
| 6,392,516 | B1 | 5/2002 | Ward et al. | |
| 2004/0061583 | A1 | 4/2004 | Yumita | |
| 2010/0126445 | A1* | 5/2010 | Schiepp | F01L 1/053 123/90.16 |
| 2011/0079191 | A1* | 4/2011 | Lengfeld | F01L 1/053 123/90.18 |
| 2013/0293035 | A1* | 11/2013 | Elendt | H02K 3/00 310/12.32 |
| 2015/0308302 | A1* | 10/2015 | Popp | F01L 1/344 123/90.18 |
| 2015/0322830 | A1* | 11/2015 | Rigling | F01L 13/0036 123/90.11 |
| 2015/0330270 | A1* | 11/2015 | Noda | F01L 1/08 123/90.2 |
| 2015/0377092 | A1* | 12/2015 | Steigerwald | F01L 9/04 123/90.11 |
| 2016/0125990 | A1* | 5/2016 | Strigerwald | H01F 7/08 335/229 |
| 2016/0186622 | A1* | 6/2016 | Gruener | H01F 7/1646 123/90.11 |
| 2017/0011834 | A1 | 1/2017 | Gilmore | |
| 2017/0178779 | A1* | 6/2017 | Maisch | F01L 13/0036 |
| 2018/0087887 | A1* | 3/2018 | Sugawara | H01F 7/081 |
| 2018/0172478 | A1* | 6/2018 | Sugawara | G01B 7/04 |
| 2019/0043648 | A1* | 2/2019 | Vincon | H01F 7/16 |

FOREIGN PATENT DOCUMENTS

| | | |
|---|---|---|
| DE | 102010045601 | 3/2012 |
| DE | 102011009327 | 7/2012 |
| DE | 102012213660 | 2/2014 |
| DE | 102013101437 | 8/2014 |
| DE | 102013203954 | 9/2014 |
| FR | 2122024 | 8/1972 |
| JP | S57177511 | 11/1982 |
| JP | 2016131163 | 7/2016 |
| JP | 2017005123 | 1/2017 |

* cited by examiner

ADJUSTING DEVICE WITH SEALED GUIDE CYLINDER

CROSS REFERENCE TO RELATED APPLICATIONS

This application is a § 371 National Phase of PCT/EP2018/072039, filed Aug. 14, 2018, the entirety of which is incorporated by reference and which claims priority to German Patent Application No. 10 2017 121 947.1, filed Sep. 21, 2017.

BACKGROUND

The application relates to an adjusting device having the features and structures disclosed herein and a motor vehicle with such adjusting device. The application relates in particular to an adjusting device for changing the valve opening and/or the valve opening times in internal combustion engines and/or to an adjusting device for the partial cylinder cutoff of internal combustion engines.

SUMMARY

Adjusting devices, in particular adjusting devices with electromagnetically operated actuators, are utilized in motor vehicle technology for opening and closing the inlet as well as the outlet valves of cylinders of Diesel and/or gasoline motors, which introduce the fuel mixture into the combustion chamber and lead the combusted waste gases out of the combustion chamber again. Toward the attainment of the highest efficiency possible of the combustion engine, the points in time of the opening and the closing of the valves must be set precisely, which takes place by means of a valve control or of a valve operating mechanism. By this term is understood the mechanism which controls the valves in a reciprocating piston engine, and therewith the gas-exchange cycle, by opening and closing the inlet and the combustion gas outlet channels. As a rule, the valve is herein opened by a cam shaft across a tappet, a cam follower or rocker arm. Closing of the valves is carried out by helical springs, pneumatic springs or positively controlled via a closing cam. The cam shaft is herein driven by the crank shaft of the engine.

In prior art so-called sliding cam systems have been found to be useful that comprise a cam shaft with grooves disposed such that they extend about the rotational axis of the cam shaft. The grooves are operationally connected with a front end of a tappet of the adjusting device, wherein, in the actuated state of the adjusting device, at least one front end of the tappet engages into the cam shaft. Such adjusting devices are comprised of a pair of tappets movable in parallel to one another, that alternately engage into the grooves of the sliding cam shaft and thus cause a movement of the sliding cam shaft, whereby the valves are actuated. Such an adjusting device is disclosed, for example, in DE 10 2011 009 327 B4.

Of disadvantage of this prior art was found to be that it is necessary to use considerable effort to seal the adjusting devices in order to prevent the leakage of lubricants from the cam shaft housing. Sealing of the tappets is always connected with friction. The actuators of the tappets must consequently be more powerful and are correspondingly heavier and more expensive. The adjusting device therefore typically comprises a large number of sealings that seal the guide cylinder and the housing.

The assembly of such a sliding cam system with a sliding cam shaft and an adjusting device has moreover been found to be extremely complex and involves effort. The adjusting device and the sliding cam shaft have to be brought into the precise position relative to one another. It has been found that restraints or tensioning, for one, lead to the tappets canting or jamming in the guide sleeve and that, for another, in the case of deformations the sealing effect of the sealings diminishes and this allows lubricant fluids to leak.

The present disclosure therefore addresses the problem of eliminating the disadvantages of existing prior art and providing an adjusting device that offers a simplified sealing concept that is cost-effective of production and has low susceptibility to deformations. In addition, the adjusting device is to be simple to assemble and reliable in operation.

This problem is resolved through an adjusting device having the features and structures disclosed herein.

The adjusting device according to the disclosure comprises at least one tappet assembly, wherein the at least one tappet assembly comprises a tappet, at least one guide cylinder and a pole core, wherein the tappet is disposed such that it is displaceable in the guide cylinder from a nonactivated state into an activated state along a longitudinal axis. The activated state corresponds to an engagement position into the grooves of a cam shaft and the nonactivated state corresponds to the retracted position into the guide cylinder in which there is no engagement into the grooves of the cam shaft.

According to the disclosure, a non-magnetic connection bushing is disposed between the guide cylinder and the pole core, wherein the guide cylinder and the pole core are disposed at a spacing in the longitudinal axis through the connection bushing. The pole core and the guide cylinder are produced of a soft-magnetic material, while the connection bushing, due to the non-magnetic properties, forms a gap for a magnetic side flux. The connection bushing can be connected with the pole core and the guide cylinder under form closure, material closure or force closure.

It is furthermore especially advantageous for the connection bushing to be produced of a high-grade steel. Non-magnetic high-grade steels are, for example, chromium-nickel steels with austenitic structure. These are sufficiently well processed and, at the required thin-walled structural form, have sufficient strength to do justice to the mechanical, often impact-like, loading.

It has, moreover, been found to be especially advantageous for the spacing between the guide cylinder and the pole core to be adapted to the working stroke of the particular tappet. The spacing between the guide cylinder and the pole core should correspond to the working stroke of the tappet. However, it can also deviate from the working stroke by up to ±50%.

According to a further implementation of the present application, it is of advantage if the connection bushing with the pole core and/or the connection bushing with the guide cylinder are connected so as to be pressure-tight. In particular suitable for a pressure-tight connection are welded connections which can be produced cost-effectively and simply and have high strength. The connection between the pole core and the guide cylinder is namely subject to high mechanical load during the abrupt resetting or advancing of the tappet.

It is furthermore especially advantageous for the adjusting device to comprise at least one first tappet assembly and at least one second tappet assembly that are disposed in parallel and spaced apart vertically on a connection plate. The connection plate comprises at least one first cutout and at least one second cutout, wherein the at least first tappet assembly penetrates through the at least first cutout and the at least second tappet assembly penetrates through the at least second cutout, wherein between at least one of the cutouts and one of the tappet assemblies a clearance is provided. The clearance is a revolving gap between the tappet assembly and the cutout and can be achieved either by the cutout being implemented larger or through the appropriate adaptation of the outer diameter of the guide cylinder to the particular tappet assembly. The cutouts are preferably bores. The result, in particular, is that generous fabrication tolerances on the side of the cam shaft housing and on the side of the adjusting device can be realized whereby marked cost advantages can be obtained. The generous tolerances can be compensated through the floating bearing of the tappet assembly on the connection plate without, due to strains or tensions, the tappets being able to cant or jam in their guide sleeves.

According to a further implementation of the present application, it is especially advantageous for the particular tappet assembly to comprise at least one actuator that is operationally connected with a rearward end of the tappet. Through the cooperation of the actuators with the particular tappets, these are guided in the particular tappet assembly along the longitudinal axis on a common cam shaft and engage into at least one groove. The actuators can activate the tappets of the particular tappet assembly independently of one another, wherein the actuators are advantageously developed in the form of rods and are movably guided in the particular guide cylinder of the tappet assembly. For this purpose, cylindrical actuators are especially suitable. The actuators can be controlled mechanically, magnetically or electromagnetically.

It is furthermore especially advantageous for the actuators to be magnetically or electromagnetically controllable and for each actuator to be surrounded by a separate actuator coil. The actuators can thereby be specifically activated by means of simple electrical signals, such that onto the tappets an optimized pressure sequence is exerted which ensures that the internal combustion engine operates in each case in the optimized operating range.

It is further preferred for the particular guide cylinder to be formed of a first guide sleeve and a second guide sleeve. The first guide sleeve forms at the connection side a guide cylinder opening through which the tappet is guided along the longitudinal axis in the direction of the cam shaft and is stayed in the manner of a sliding bearing. The first guide sleeve can preferably be produced of a non-magnetic material in order to stabilize the friction conditions during the axial movement. The second guide sleeve is advantageously disposed on the side, facing away from the guide cylinder opening, of the first guide sleeve and regionally encompasses, together with the first guide sleeve, the tappet and the actuator. The second guide sleeve can be produced of a magnetic material, wherein advantageously on the side, facing the tappet or the actuator, of the second guide sleeve a sheath of a non-magnetic metal, for example of a chromium-nickel alloy, can be applied in order to stabilize the friction during the axial movement of the tappet or of the actuator.

The first guide sleeve and the second guide sleeve are typically plugged one into the other, preferably for the connection of a pressure-tight connection. The connection between the first guide sleeve and the second guide sleeve can, moreover, be an adhesive connection or a pressure connection or the like.

It is furthermore preferred for the second guide sleeve to [bearing-]support the actuator on a rearward end of the tappet and for the first guide sleeve [to support] the tappet. The second guide sleeve is accordingly disposed between the particular actuator coil and the particular actuator.

It is furthermore advantageous for a spring element to be provided which, on the one hand, is stayed on the guide cylinder and, on the other hand, is in operational contact with the tappet. The spring element is, for example, stayed on an offset in the first guide cylinder as a compression spring or on an inner offset in the second guide cylinder as a tension spring. To establish the contact between the spring element and the particular tappet, the tappet can comprise a spring plate. The spring plate can be placed onto the tappet, be formed onto it or worked onto it. The spring plate, moreover, serves for the guidance of the tappet in the particular guide cylinder. The first spring element can be a helical spring wound in the left-hand direction and the second spring element a helical spring wound in the right-hand direction and conversely. In particular the compression springs disposed in the opposite rotational direction prevent jamming of the tappets.

It is, moreover, especially advantageous for the guide cylinder to comprise a sealing on an outer surface. The sealing can be developed as a conventional sealing ring and close a gap between the guide cylinder and a housing opening of a cam shaft housing. Especially in combination with a guide cylinder sealed tightly at the rearward end, the adjusting device is sealed in the mounted state on a cam shaft housing and further sealings within the housing are not necessary.

It is furthermore advantageous for the particular guide cylinder to comprise a contact face that is in contact on the connection side of the connection plate, whereby an especially simple mounting of the adjusting device is realized. During the mounting of the adjusting device onto the cam shaft housing no forces consequently act onto the actuator coil.

According to a further advantageous implementation of the present application, a sliding bushing is provided in the guide cylinder, through which the maximal working stroke of the particular tappet in the longitudinal axis is predetermined. The tappet can preferably be disposed in the volume enclosed by the first guide sleeve and the second guide sleeve, with the tappet such that an additional fixing of the sleeve is not necessary. Such a sliding bushing is a cost-effective structural part which is preferably produced of a non-magnetic material and permits a simple individualizable setting of the working stroke of an adjusting device and ensures the low-friction bearing of the tappet. The low-friction bearing of the tappet in particular reduces the necessary feed or advance forces.

It is, furthermore, especially advantageous for a housing to encompass the tappet assembly on the side, facing away from the connection side, of the connection plate. The housing protects the tappet assembly against external effects and contaminations.

Moreover, it is furthermore advantageous for the adjusting device to be implemented in a cartridge design. The adjusting device, especially the particular guide cylinder, comprises for this purpose guide faces through which, during the emplacement or insetting of the adjustment device onto or into the cam shaft housing, self-centering of the tappet assembly of the adjusting device takes place. The clearances between at least one cutout and one tappet assembly permit the shifts required during the self-centering without tensioning or deformation occurring in the particular tappet assembly.

The present application relates further to a motor vehicle with an adjusting device according to the disclosure. The adjusting device comprises at least one tappet assembly that comprises at least one tappet, at least one guide cylinder and one pole core, wherein the tappet is disposed such that it is displaceable along a longitudinal axis in the guide cylinder, wherein between the guide cylinder and the pole core a non-magnetic connection bushing is disposed and wherein the guide cylinder and the pole core are disposed at a spacing in the longitudinal axis through the connection bushing.

BRIEF DESCRIPTION OF THE DRAWING

In the following a preferred embodiment example of the application will be described in detail with reference to the accompanying drawing. In the drawing depict.

DETAILED DESCRIPTION

In the following an adjusting device 1 according to a preferred embodiment example of the disclosure will be described in detail with reference to FIGS. 1 and 2.

Figure 1:
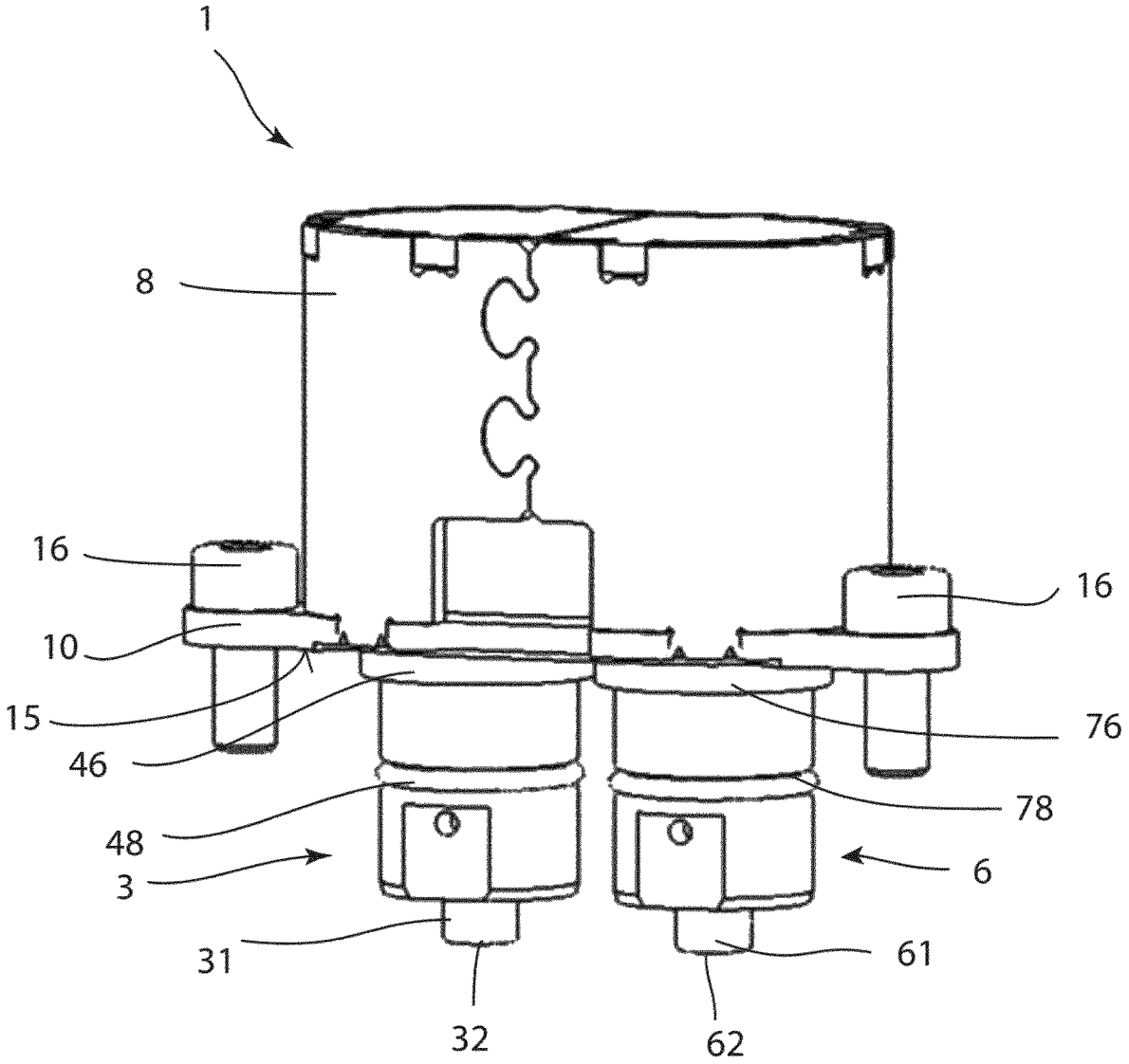
FIG. 1 a perspective view of an adjusting device according to the disclosure with a tappet assembly with a guide cylinder closed as half-open cylinder by means of a lid-shaped pole core and a non-magnetic connection bushing, and FIG. 2 a schematic and sectional view of the adjusting device according to FIG. 1.

FIG. 1 shows the adjusting device 1 with a first tappet assembly 3, a second tappet assembly 6 and a connection plate 10. The connection plate 10 is equipped to secure the adjusting device 1 on a not-shown cam shaft housing. The tappet assemblies 3, 6 are substantially of identical structure and parallel to one another and spaced apart and each comprises a tappet 31, 61 disposed such that it is longitudinally displaceable in a particular guide cylinder 34, 64 along a longitudinal axis 30, 60 by a working stroke 59, 89. The working stroke 59, 89 is depicted by means of double arrows in FIG. 2.

The particular tappet 31, 61 comprises a front end 32, 62 and a rear end 33, 63, wherein the front end 32, 62 projects through a guide cylinder opening 59 [sic: 49], 79, worked into the particular guide cylinder 34, 64, and at the rear end 33, 63 is disposed an actuator 35, 65.

For the purpose of connecting with the cam shaft housing, the adjusting device 1 or the connection plate 10 comprises several bolts 16. Furthermore, the first tappet assembly 3 and the second tappet assembly 6 are encompassed on the side, facing away from the connection side 15, of the connection plate 10 by a housing 8. The adjusting device 1 is consequently developed in a cartridge design that is distinguished thereby that the adjusting device 1 can be emplaced and secured on a cam shaft housing with low effort.

Figure 2:
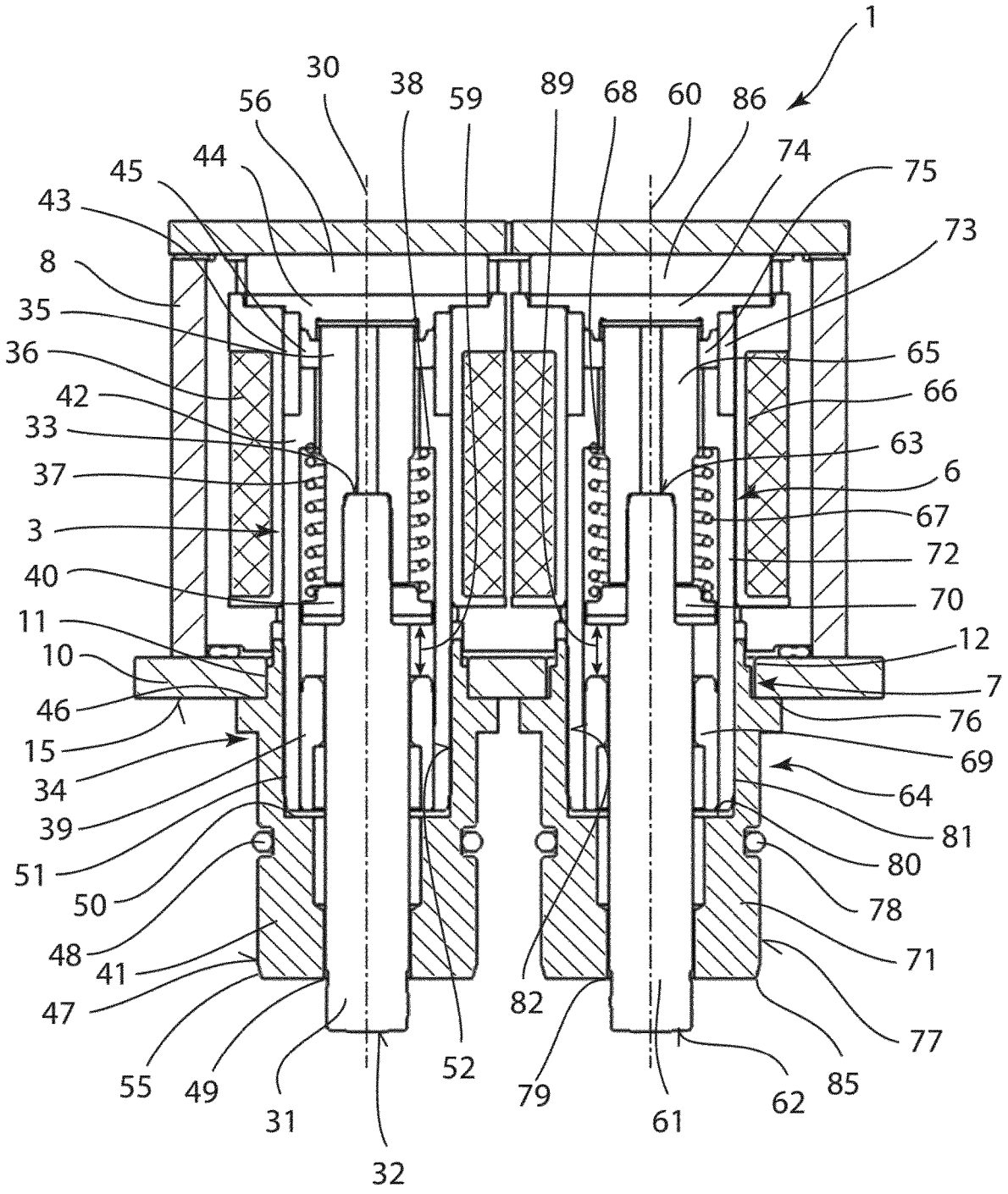

In FIG. 2 is evident that the connection plate 10 comprises a first cutout 11 and a second cutout 12, wherein the first cutout 11 is provided for the first tappet assembly 3 and the second cutout 12 for the second tappet assembly 6. The longitudinal axis 30 of the first tappet assembly 3 and the longitudinal axis 60 of the second tappet assembly 6 are oriented vertically with respect to the connection plate 10 and extend at a spacing from one another.

The particular tappet 31, 61 is guided through the cutout 11, 12 by means of the particular guide cylinder 34, 64, wherein the second tappet assembly 6 is held floatingly with a clearance 7 in the second cutout 12 so as to avoid a double fit with the cam shaft housing (not shown). The second tappet assembly 6 is correspondingly held movably, preferably by ±0.5 mm, in the plane of the connection plate 10.

The clearance 7 can be realized either by a larger dimensioned cutout 11, 12 or through a smaller dimensioned outer circumference or diameter of the particular guide cylinder 34, 64. In the mounted state of the adjusting device 1 in the cutout 12, the clearance 7 is an annular gap between the connection plate 10 and the guide cylinder 34, 64. The clearance 7 or the floating bearing, moreover, during the mounting of the adjusting device 1 onto the cam shaft enables the self-centering of the guide cylinders 34, 64 by means of guide faces 55, 85 provided for this purpose. The guide faces 55, 85 are developed, for example, as bevels.

The particular guide cylinder 34, 64 is developed as two parts comprising a first guide sleeve 41, 71 and a second guide sleeve 42, 72 which are plugged pressure-tight together with a plug connection 51, 81. The first guide sleeve 41, 71 is produced of a non-magnetic material and comprises on an inner jacket surface 52, 82 an inner offset 50, 80. The second guide sleeve 42, 72 is set under form closure into the first guide sleeve 41, 71 up to the inner offset 50, 80. The second guide sleeve 42, 72 is produced of a soft magnetic material and is typically provided with a non-magnetic metal coating on the side facing the actuator 35, 65 or the tappet 31, 61, through which metal coating the friction during the axial movement of the tappet 31, 61 or of the actuator 35, 65 is stabilized. The metal coating is preferably a chromium-nickel alloy.

It is furthermore shown in FIG. 2 that the end of the particular guide cylinder 34, 64, associated with the rear end 33, 63, is closed by means of a lid-like pole core 44, 74 and a connection bushing 43, 73. The pole core 44, 74 is produced of a soft magnetic material. On the side, facing away from the guide cylinder 34, 64, of the pole core 44, 74 a permanent magnet 56, 86 is disposed.

Between the pole core 44, 74 and the guide cylinder 34, 64 or the second guide sleeve 42, 72 the connection bushing 43, 73 is disposed by which the particular guide cylinder 34, 64 is indirectly connected with the pole core 44, 74. The connection bushing 43, 73 is produced of a non-magnetic material, preferably a high-grade metal of an austenitic alloy, and welded to the guide cylinder 34, 64, or the particular second guide sleeve 41, 71 [sic: 42, 72], and the particular pole core 44, 74 to form a pressure-tight, gas-tight and fluid-tight connection. The guide cylinder 34, 64 is accordingly a half-open cylinder with a closed end and an open end that comprises the guide cylinder opening 49, 79.

The pole core 44, 74 and the guide cylinder 34, 64 are disposed such that they are spaced apart from one another through the connection bushing 43, 73, whereby through the connection bushing 43, 73 a magnetically permeable gap 45, 75 for a magnetic side flux is formed. The height of the particular gap 45, 75 in the longitudinal axis 30, 60 corresponds substantially to the maximal working stroke 59, 89 of the particular tappet 31, 61. However, discrepancies of ±50% are feasible.

The second guide sleeve 42, 72 has an offset 38, 68, in contact on which a spring element 37, 67 rests. The spring element 37, 67 is, on the one hand, stayed on the offset 38, 68 and, on the other hand, is in operational connection with the tappet 31, 61 or with a spring plate 40, 70 of the tappet 31, 61. The first spring element 37 is a helical spring wound in the left-hand direction and the second spring element 67 is a helical spring wound in the right-hand direction, wherein the spring elements 37, 67 can be implemented as fiber glass-reinforced synthetic springs.

The spring plate 40, 70 in this embodiment example is developed as a flanged adapter disposed between an actuator 35, 65 and the particular tappet 31, 61. The actuator 35, 65 is in operational connection with the particular rear end 33, 63 of the tappet [31, 61]. About the actuator 35, 65 is disposed in each instance an electrically controllable actuator coil 36, 66 which can be activated for the advancing of the particular actuator 35, 65.

The permanent magnet 56, 86 exerts a force of attraction onto the actuator 35, 65 along the longitudinal axis 30, 60 such that the actuator 35, 65 is pulled into a retracted position or is pulled by the permanent magnet 56, 86 and consequently is in contact on the pole core 44, 74. This state corresponds to the nonactivated state. The spring element 37, 67 is hereby compressed, whereby a prestress force is provided that is lower than the force of attraction of the particular permanent magnet 56, 86. The actuator 35, 65 and the tappet 31, 61 assume the retracted position or the nonactivated state.

To advance the particular actuator 35, 65, the actuator coil 36, 66 is energized and a magnetic field is build up which induces a magnetic force onto the actuator 35, 65. The magnetic force acts in the same direction as the prestress force provided by the spring element 37, 67, which prestress force acts against the force of attraction of the permanent magnet 56, 86. The sum of the magnetic force and the prestress force is greater than the force of attraction exerted by the permanent magnet 56, 86. The particular actuator 35, 65 and the particular tappet 31, 61 are consequently advanced under guidance in the corresponding guide cylinder 34, 64 axially along the longitudinal axis 30, 60 until the front end 32, 62 of the particular tappet 31, 61 engages into a groove of a cam shaft (not shown). The cam shaft (not shown) herein rotates about an axis extending perpendicularly to the particular longitudinal axis 30, 60 of the tappets 31, 61. The tappet 31, 61 is in the activated state.

The maximal working stroke 59, 89 of the particular tappet 31, 61 is set by means of a sliding bushing 39, 69, which is disposed within the particular guide cylinder 34, 64 and is stayed on an inner offset 50, 80 in the longitudinal axis 30, 60 and is set up so as to establish at the maximal working stroke 59, 89 an operational connection with the spring plate 40, 70.

For resetting the particular tappet 31, 61 the current of the particular actuator coil 36, 66 is turned off and the permanent magnet [56, 86] pulls the actuator 35, 65 together with the tappet 31, 61 back into the guide cylinder 34, 64 until the actuator 35, 65 is in contact on the pole core 44, 74. The spring element 37, 67 is consequently again compressed and the prestress force is provided. In this nonactivated state the gap 45, 75 for the magnetic side flux is disposed in a plane between the actuator coil 36, 66 and the actuator 35, 65.

The first guide sleeve 41, 71 and the second guide sleeve 42, 72 herein regionally encompass the particular tappet 31, 61, wherein the second guide sleeve 42, 67 [sic: 72] is disposed in the region of the rear end 33, 63 and regionally supports the particular actuator 35, 65 along the longitudinal axis 30, 60. For this purpose, the actuator 35, 65 is developed in the form of a cylinder and emplaced on the particular rear end 33, 63 of the particular tappet 31, 61. The connection between the particular actuator 35, 65 and the particular tappet 31, 61 can be one of form closure, force closure, adhesion connection or the like.

An especially simple mounting of the adjusting device 1 results from the shaping of the guide cylinders 34, 64 of the first tappet assembly 3 and the second tappet assembly 6. The particular first guide sleeve 41, 71 is introduced from the connection side 15 into the first cutout 11 or the second cutout 12 and is in each instance in contact, by means of a contact face 46, 76, on the connection side 15 of the connection plate 10. The contact face 46, 76 is worked or molded in the manner of a projecting flange onto the particular first guide sleeve 41, 71. On one of the outer surfaces 47, 77 of the particular first guide sleeve 41, 71 a sealing 48, 78 is disposed through which the particular outer surface 47, 77 of the particular tappet assembly 3, 6 cooperates with a cam shaft housing. Consequently, a connection is established that is liquid-, gas- and pressure-tight with respect to the outer surface 47, 77 between the particular tappet assembly 3, 6 and the cam shaft housing. According to definition, the outer surface 47, 77 is, on the one side, the outer jacket surface and the surface of the front side between the contact face 46, 76 and the guide cylinder opening 49, 79.

In particular, from the cooperation of the tappet assemblies 3, 6 that are closed pressure-tight at the rear end and the sealings 48, 78 there results the advantage that the adjusting device 1 can be placed pressure-tight onto a cam shaft housing even in the presence of generous fabrication tolerances. The clearance 7 between at least one of the cutouts 11, 12 and at least one of the tappet assemblies 3, 6 compensates generous tolerances without a liquid leakage developing between the adjusting device 1 and the cam shaft housing.

According to the disclosure, an adjusting device 1 can consequently be provided that enables generous tolerances in the fabrication of the adjusting device 1 as well as of the cam shaft housing and thus is cost-effective of production and mounting and simultaneously realizes a reliable sealing. Simple compensation of fabrication tolerances is enabled through the clearance 7 between the at least one tappet assembly 3, 6, whereby through the cooperation of the tappet assembly 3, 6, sealed by means of the connection bushing 43, 73, and the sealings 48, 78 a reliable sealing effect is accomplished which can be realized in an especially simple manner.

LIST OF REFERENCE NUMBERS

1 Adjusting device
3 First tappet assembly
6 Second tappet assembly
7 Clearance
8 Housing
10 Connection plate
11 First cutout
12 Second cutout
15 Connection side
16 Bolts
30 Longitudinal axis
31 Tappet
32 Front end
33 Rear end
34 Guide cylinder
35 Actuator
36 Coil
37 Spring element
38 Offset
39 Sliding bushing
40 Spring plate
41 First guide sleeve
42 Second guide sleeve
43 Connection bushing

44 Pole core
45 Gap
46 Contact face
47 Outer surface
48 Sealing
49 Guide cylinder opening
50 Inner offset in 41
51 Plug connection
52 Inner jacket surface
55 Guide face
56 Permanent magnet
59 Working stroke
60 Longitudinal axis
61 Tappet
62 Front end
63 Rear end
64 Guide cylinder
65 Actuator
66 Coil
67 Spring element
68 Offset
69 Sliding bushing
70 Spring plate
71 First guide sleeve
72 Second guide sleeve
73 Connection bushing
74 Pole core
75 Gap
76 Contact face
77 Outer surface
78 Sealing
79 Guide cylinder opening
80 Inner offset in 71
81 Plug connection
82 Inner jacket surface
85 Guide face
86 Permanent magnet
89 Working stroke

The invention claimed is:

1. An adjusting device, comprising:

a tappet assembly, wherein the tappet assembly comprises a tappet, a guide cylinder and a pole core, wherein the tappet assembly includes a first tappet assembly and a second tappet assembly disposed in parallel and spaced apart from each other on a connection plate, wherein the connection plate comprises a first cutout and a second cutout, wherein the first tappet assembly penetrates the first cutout, wherein the second tappet assembly penetrates the second cutout, and wherein a clearance is provided between one of the first or second cutouts and one of the first or second tappet assemblies, respectively, wherein the tappet is configured to be displaced along a longitudinal axis in the guide cylinder, wherein a non-magnetic connection bushing is disposed between the guide cylinder and the pole core, and wherein a spacing between the guide cylinder and the pole core along the longitudinal axis is defined by the connection bushing.

2. The adjusting device of claim 1, wherein the connection bushing comprises a steel.

3. The adjusting device of claim 2, wherein the steel is a chromium-nickel steel with austenitic structure.

4. The adjusting device of claim 1, wherein the spacing is up to ±50% of a working stroke of the tappet.

5. The adjusting device of claim 1, wherein the connection bushing is connected pressure-tight with the pole core, the guide cylinder, or both the pole core and the guide cylinder, by a welded connection.

6. The adjusting device of claim 1, wherein the tappet assembly further comprises an actuator that is in operational connection with a front end of the tappet.

7. The adjusting device of claim 6, wherein the actuator is magnetically controlled and encompassed by an actuator coil.

8. The adjusting device of claim 7, wherein in a nonactivated state of the tappet the connection bushing is disposed between the actuator coil and the actuator.

9. The adjusting device of claim 7, wherein a magnetic flux flows through the connection bushing.

10. The adjusting device of claim 1, wherein the guide cylinder is formed of a first guide sleeve and a second guide sleeve which are connected pressure-tight with one another.

11. The adjusting device of claim 10, wherein the first guide sleeve is produced out of a non-magnetic material and supports the tappet along the longitudinal axis and the second guide sleeve is produced out of a magnetic material and supports the actuator along the longitudinal axis.

12. The adjusting device of claim 1, wherein a recuperating spring is provided which is disposed on the guide cylinder and is in operational contact with the tappet.

13. The adjusting device of claim 1, wherein the guide cylinder comprises a sealing on an outer surface.

14. The adjusting device of claim 1, wherein the guide cylinder comprises a contact face that is in contact on a connection side of the connection plate.

15. The adjusting device of claim 14, further comprising a housing disposed opposite the connection side.

16. The adjusting device of claim 1, wherein a sliding bushing is provided by which a maximal working stroke of the tappet along the longitudinal axis is defined.

17. The adjusting device of claim 1, wherein the tappet assembly has a cartridge shape.

18. A motor vehicle with the adjusting device of claim 1.

* * * * *